US010689073B2

(12) United States Patent
Kray et al.

(10) Patent No.: US 10,689,073 B2
(45) Date of Patent: Jun. 23, 2020

(54) APPARATUS AND SYSTEM FOR MARINE PROPELLER BLADE DOVETAIL STRESS REDUCTION

(71) Applicant: General Electric Company, Schenectady, NY (US)

(72) Inventors: Nicholas Joseph Kray, Mason, OH (US); Stefaan Guido Van Nieuwenhove, Bavaria (DE); Peggy Lynn Baehmann, Glenville, NY (US)

(73) Assignee: General Electric Company, Schenectady, NY (US)

( * ) Notice: Subject to any disclaimer, the term of this patent is extended or adjusted under 35 U.S.C. 154(b) by 467 days.

(21) Appl. No.: 15/295,679

(22) Filed: Oct. 17, 2016

(65) Prior Publication Data

US 2018/0105246 A1 Apr. 19, 2018

(51) Int. Cl.
*B63H 1/20* (2006.01)
*F01D 5/30* (2006.01)

(52) U.S. Cl.
CPC ..... *B63H 1/20* (2013.01); *F01D 5/30* (2013.01); *F05D 2260/941* (2013.01)

(58) Field of Classification Search
CPC ..... B63H 1/20; B63H 1/26; B63H 2748/00; F01D 5/30; F01D 5/3023
USPC ..... 416/245 A, 244 B, 219 R, 220 R
See application file for complete search history.

(56) References Cited

U.S. PATENT DOCUMENTS 123,274 A * 1/1872 McCay ..... F04D 29/34 416/214 R
1,050,119 A 1/1913 Flanders
2,474,562 A * 6/1949 Waterval ..... B64C 11/16 416/213 A
3,132,698 A * 5/1964 Lesher ..... B63H 1/20 416/220 R
3,246,699 A * 4/1966 Jocz ..... B63H 1/20 29/889.6
4,451,205 A * 5/1984 Honda ..... F01D 5/22 416/193 A
4,466,776 A 8/1984 Camboulives
4,645,425 A * 2/1987 Morrison, Jr. ..... F01D 5/3038 416/215

(Continued)

FOREIGN PATENT DOCUMENTS

GB 761 380 A 11/1956
JP 2014-125047 A 7/2014
KR 2016-0052842 A 5/2016

OTHER PUBLICATIONS

International Search Report and Written Opinion issued in connection with corresponding PCT Application No. PCT/US2017/51092 dated Nov. 22, 2017.

*Primary Examiner* — Kenneth J Hansen
*Assistant Examiner* — Maranatha Boardman
(74) *Attorney, Agent, or Firm* — Dority & Manning, P.A.

(57) ABSTRACT

An apparatus and system for a marine propeller assembly are provided. In one aspect, the marine propeller assembly includes a plurality of circumferentially-spaced blades that each include a dovetail having a radial inner surface. The marine propeller assembly also includes a hub including a plurality of circumferentially-spaced dovetail receiving portions configured to receive a corresponding dovetail of the plurality of blades. At least one gap is formed between the radial inner surface and at least a portion of the dovetail receiving portion.

20 Claims, 5 Drawing Sheets

(56) References Cited

U.S. PATENT DOCUMENTS

| | | | | |
|---|---|---|---|---|
| 4,930,987 | A | 6/1990 | Stahl | |
| 5,018,941 | A | 5/1991 | Heurtel et al. | |
| 5,256,035 | A | 10/1993 | Norris et al. | |
| 5,431,542 | A | 7/1995 | Weisse et al. | |
| 5,611,665 | A | 3/1997 | Angel | |
| 5,720,596 | A * | 2/1998 | Pepperman | B63H 1/20 416/220 R |
| 6,312,223 | B1 | 11/2001 | Samuelsson | |
| 6,481,969 | B2 * | 11/2002 | Berry | F01D 5/027 416/145 |
| 6,537,031 | B1 | 3/2003 | Bacskay | |
| 7,056,092 | B2 * | 6/2006 | Stahl | B63H 1/14 416/129 |
| 8,235,666 | B2 | 8/2012 | Rosenkranz et al. | |
| 8,608,446 | B2 | 12/2013 | Pickens et al. | |
| 8,708,656 | B2 * | 4/2014 | Barnett | F01D 5/3007 416/219 R |
| 8,851,852 | B2 | 10/2014 | Blatchford | |
| 9,039,378 | B2 | 5/2015 | Ulgen | |
| 9,051,845 | B2 | 6/2015 | Bommanakate et al. | |
| 9,068,465 | B2 | 6/2015 | Keny et al. | |
| 9,664,054 | B2 * | 5/2017 | Milne | F01D 5/005 |
| 9,944,372 | B1 * | 4/2018 | Stahl | B63H 1/26 |
| 2014/0079553 | A1 | 3/2014 | Ulgen | |

* cited by examiner

APPARATUS AND SYSTEM FOR MARINE PROPELLER BLADE DOVETAIL STRESS REDUCTION

BACKGROUND

The field of the disclosure relates generally to propulsion systems and, more particularly, to retaining composite marine propellers.

At least some known marine propulsion systems rely on a rotating propeller assembly including a central hub and propeller blades extending from the central hub. During operation, fluid generally flows across surfaces of the propeller assembly and through gaps defined between blades of the propeller assembly. Performance of the propeller assembly is highly dependent on the shape of the propeller assembly surfaces including those of the blades, central hub, and blade retaining members. As a result, propeller assemblies in which the shape of propeller assembly components are limited by construction methods, material limitations, component sizes, and the like, may result in sub-optimal flow characteristics, decreasing the efficiency of the propeller assembly and requiring more powerful drive systems to achieve required propulsion.

BRIEF DESCRIPTION

In one aspect, marine propeller assembly includes a plurality of circumferentially-spaced blades that each includes a dovetail having a radially inner surface. The marine propeller assembly also includes a hub including a plurality of circumferentially-spaced dovetail receiving portions configured to receive a corresponding dovetail of the plurality of blades. At least one gap is formed between the radially inner surface and at least a portion of the dovetail receiving portion.

In another aspect, a hub for use with a marine propeller assembly includes a plurality circumferentially-spaced wedge receiving portions configured to receive a corresponding wedge of a plurality of wedges and a plurality of circumferentially-spaced dovetail receiving portions configured to receive a corresponding blade of a plurality of blades. Each blade includes a dovetail including a radially inner surface. The wedge receiving portions are alternatingly circumferentially-spaced with the dovetail receiving portions, and at least one gap is formed between the radially inner surface and at least a portion of the dovetail receiving portion.

In yet another aspect, a marine propulsion system includes a rotatable propulsive shaft extending away from a hull of a water craft and a plurality of circumferentially-spaced blades. Each blade includes a dovetail having a radially inner surface. The marine propulsion system also includes a hub including a plurality of circumferentially-spaced dovetail receiving portions configured to receive a corresponding dovetail of the plurality of blades. At least one gap is formed between the radially inner surface and at least a portion of the dovetail receiving portion.

DRAWINGS

These and other features, aspects, and advantages of the present disclosure will become better understood when the following detailed description is read with reference to the accompanying drawings in which like characters represent like parts throughout the drawings, wherein.

Figure 1:
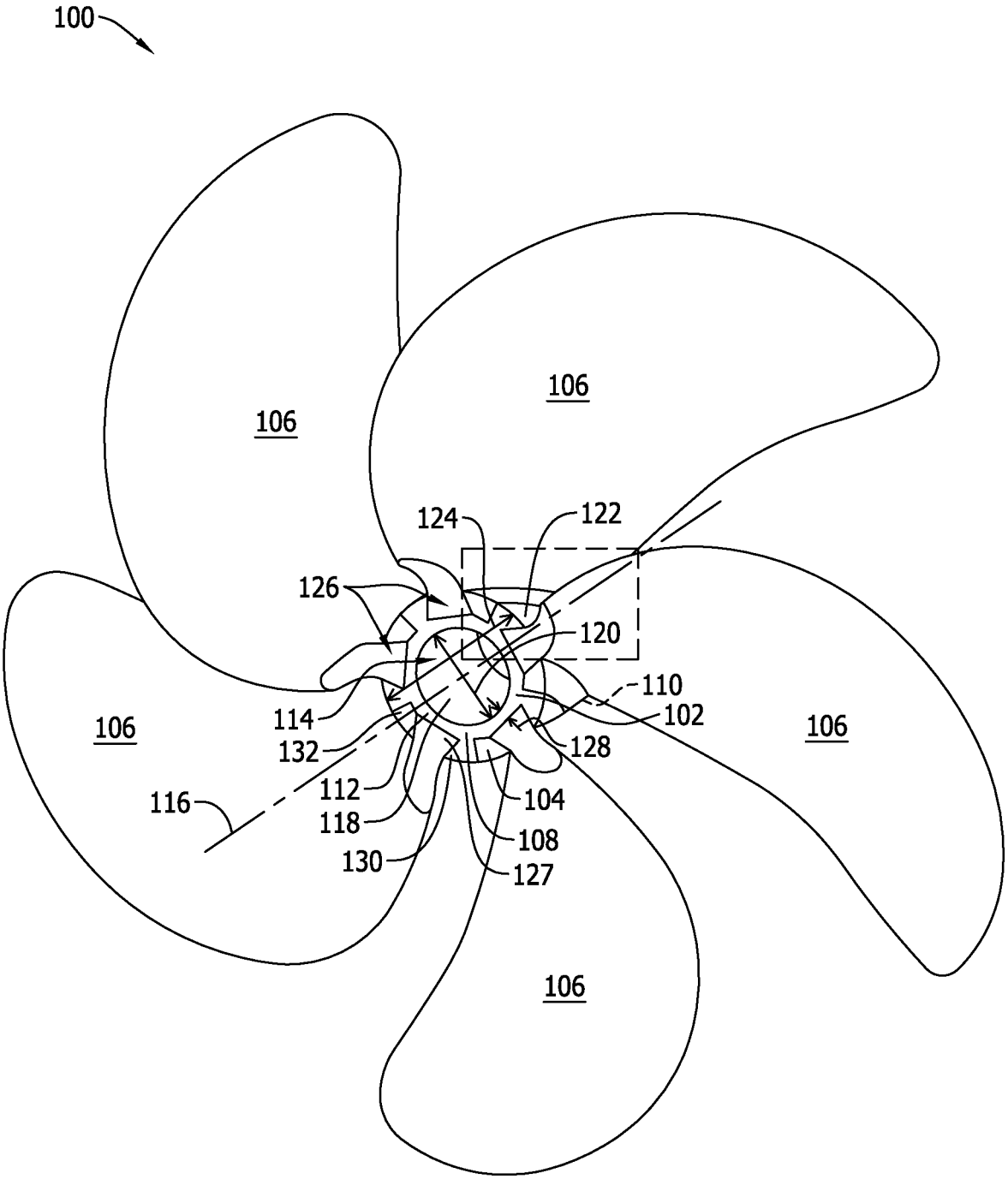
FIG. 1 is a perspective view of a marine propeller assembly in accordance with an example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of the propulsion shaft or propeller hub. Moreover, the terms "radial" and "radially" refer to directions and orientations that extend substantially perpendicular to the centerline of the propulsion shaft or propeller hub. In addition, as used herein, the terms "circumferential" and "circumferentially" refer to directions and orientations that extend arcuately about the centerline of the propulsion shaft or propeller hub.

Embodiments of the marine propeller assemblies and systems described herein provide a cost-effective method for reducing the weight of marine propellers as compared to those that are currently available. The marine propeller assemblies and systems also provide hydrodynamics efficiencies not found in current propeller assemblies. As opposed to monolithic cast and machined propeller assemblies, some embodiments of the marine propeller assemblies described herein are formed of a composite material shell with an internal structural frame and/or a filler material, such as, but not limited to a structural foam filler. The blades are formed individually and coupled to a metallic hub coupled to a propulsive shaft of a marine vessel. The separable blades provide a manageable weight and size for maintenance of the propeller system. The separable blades are retained in a dovetail groove configured to receive a dovetail of each blade. The blades are retained axially by an axial retention member couplable to the hub and configured to abut an end face of a dovetail associated with each blade. The axial tension or force used to secure each dovetail axially may be adjustable based on an axial bias member formed either in the end face of the dovetail or in the surface of the axial retention member adjacent the dovetail end face. The blades are retained radially and circumferentially using wedges configured to engage a dovetail sidewall and be coupled to the hub using fasteners.

In one embodiment, the marine propeller assembly includes the plurality of circumferentially-spaced blades that each include a dovetail having a radially inner surface. The hub includes a plurality of circumferentially-spaced dovetail receiving portions configured to receive a corresponding dovetail of the plurality of blades. At least one gap is formed between the radially inner surface and at least a portion of the dovetail receiving portion. In addition to providing axial and radial retention of the separable blades in the hub, the gaps formed between the blade dovetail and the hub facilitate reducing stress concentrations located at the intersection of the dovetail inner surface and the opposing dovetail sidewalls among other performance benefits of the propeller assembly. Such performance improvement may relate to: (a) creation of a direct load path through the propeller blades, the hub, and the drive shaft; (b) reduction of stress concentrations where the blades couple to the hub; and (c) reduction in cost of parts and labor due to an extended operational service time of the blades.

FIG. 1 is a perspective view of a marine propeller assembly 100 in accordance with an example embodiment of the present disclosure. In the example embodiment, marine propeller assembly 100 includes a hub 102, a plurality of wedges 104, and a plurality of separable blades 106.

Hub 102 includes a first face 108, a second face 110 (not shown in FIG. 1, facing away from the view in FIG. 1), and a hub body 112 extending between first face 108 and second face 110. In the example embodiment, first face 108 is spaced axially aft of second face 110. Hub body 112 includes a central bore 114 that is axisymmetric with an axis of rotation 116 of marine propeller assembly 100. Bore 114 includes a radially inner bore surface 118 having an internal diameter (ID) (not shown in FIG. 1). Hub 102 includes a radially outer hub surface 122 having an outer diameter (OD) 124. In one embodiment, outer hub surface 122 includes a plurality of dovetail grooves 126 that extend radially inwardly from outer hub surface 122 a predetermined depth 128. Each of the plurality of dovetail grooves 126 extend generally axially along hub body 112 from first face 108 to second face 110. Each of the plurality of dovetail grooves 126 includes a first undercut sidewall 130 and a second sidewall 132 spaced apart circumferentially. Each of the plurality of dovetail grooves 126 is configured to receive a respective wedge 104 of the plurality of wedges 104 and a dovetail 127 (not shown in FIG. 1) of respective blade 106 of the plurality of separable blades 106.

Figure 2:
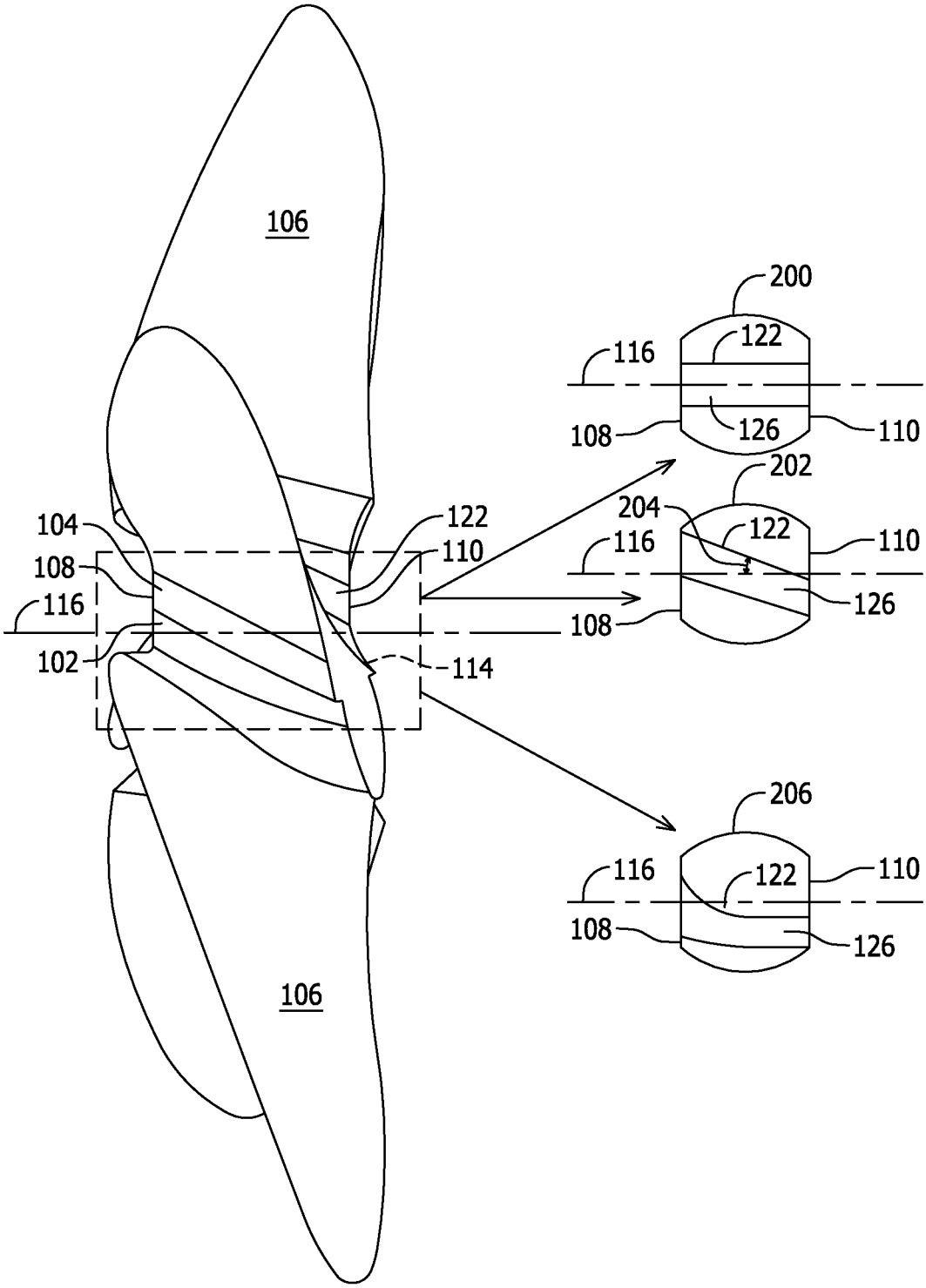
FIG. 2 is a side view of the marine propeller assembly shown in FIG. 1.

FIG. 2 is a side view of marine propeller assembly 100. In the example embodiment, a detail 200 of hub 102 illustrates dovetail groove 126 that extends straight axially between first face 108 and second face 110 parallel to axis of rotation 116. A detail 202 illustrates dovetail groove 126 that extends linearly at a skew angle 204 between first face 108 and second face 110. A detail 206 illustrates dovetail groove 126 that extends arcuately between first face 108 and second face 110.

Figure 3:
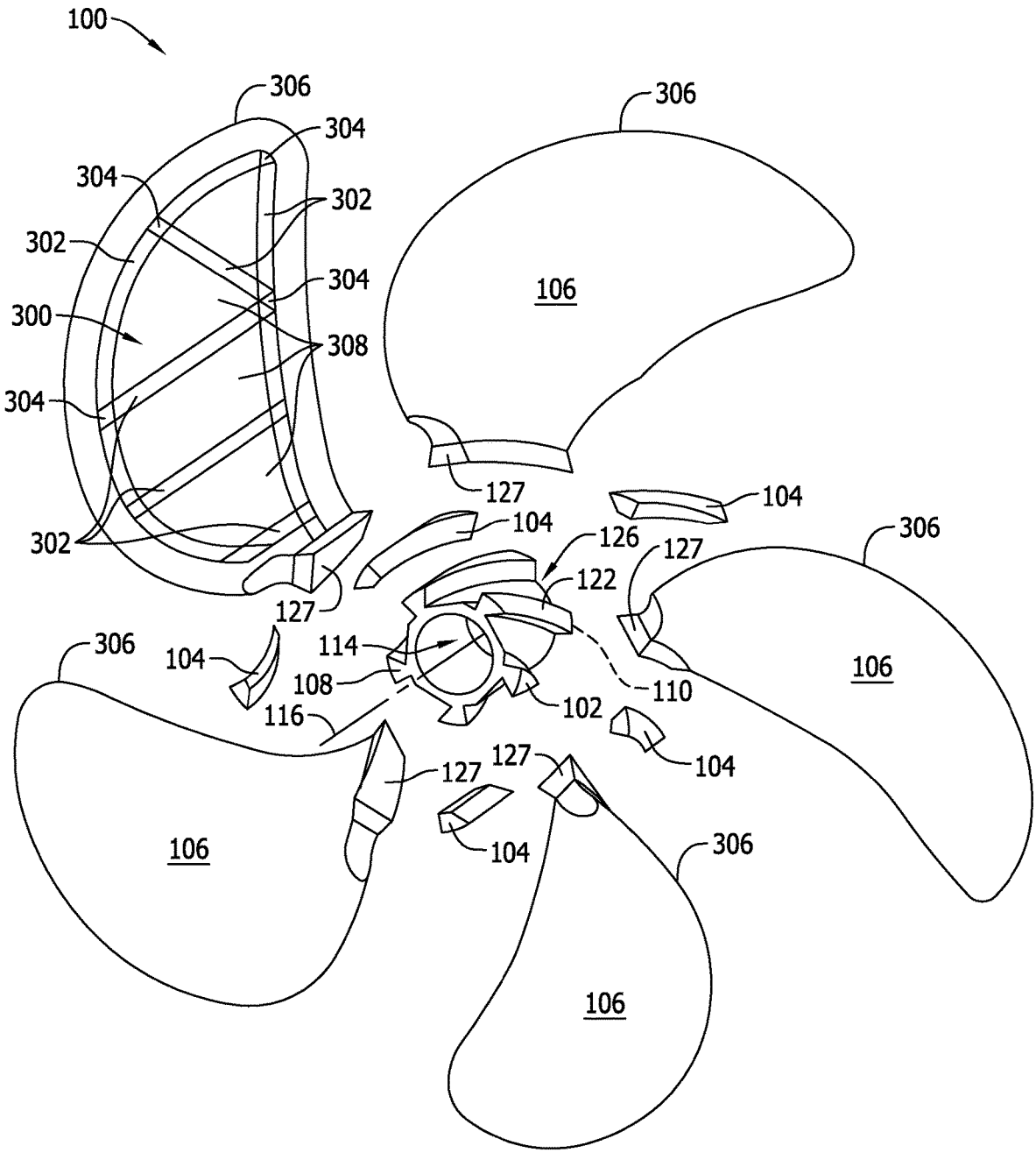
FIG. 3 is an exploded view of the marine propeller assembly shown in FIG. 1 in accordance with an example embodiment of the present disclosure.

FIG. 3 is an exploded view of marine propeller assembly 100 in accordance with an example embodiment of the present disclosure. In the example embodiment, hub 102 is illustrated with plurality of dovetail grooves 126 extending arcuately between first face 108 and second face 110. A blade 106 is illustrated cutaway showing an interior structure 300 that may be used in one embodiment. Interior structure 300 includes a plurality of frame members 302 coupled together at respective frame joints 304. In various embodiments, dovetail 127 is formed of a solid metallic material and coupled to a respective composite blade portion 306 of a respective blade 106 of plurality of blades 106. In other embodiments, each blade 106 may be formed using interior structure 300, which may be at least partially surrounded by a filler material, such as, but not limited to, a foamed material 308. In still other embodiments, each blade 106 may be formed by filling blade portion 306 with foamed material 308 such that blades 106 do not include interior structure 300.

Figure 4:
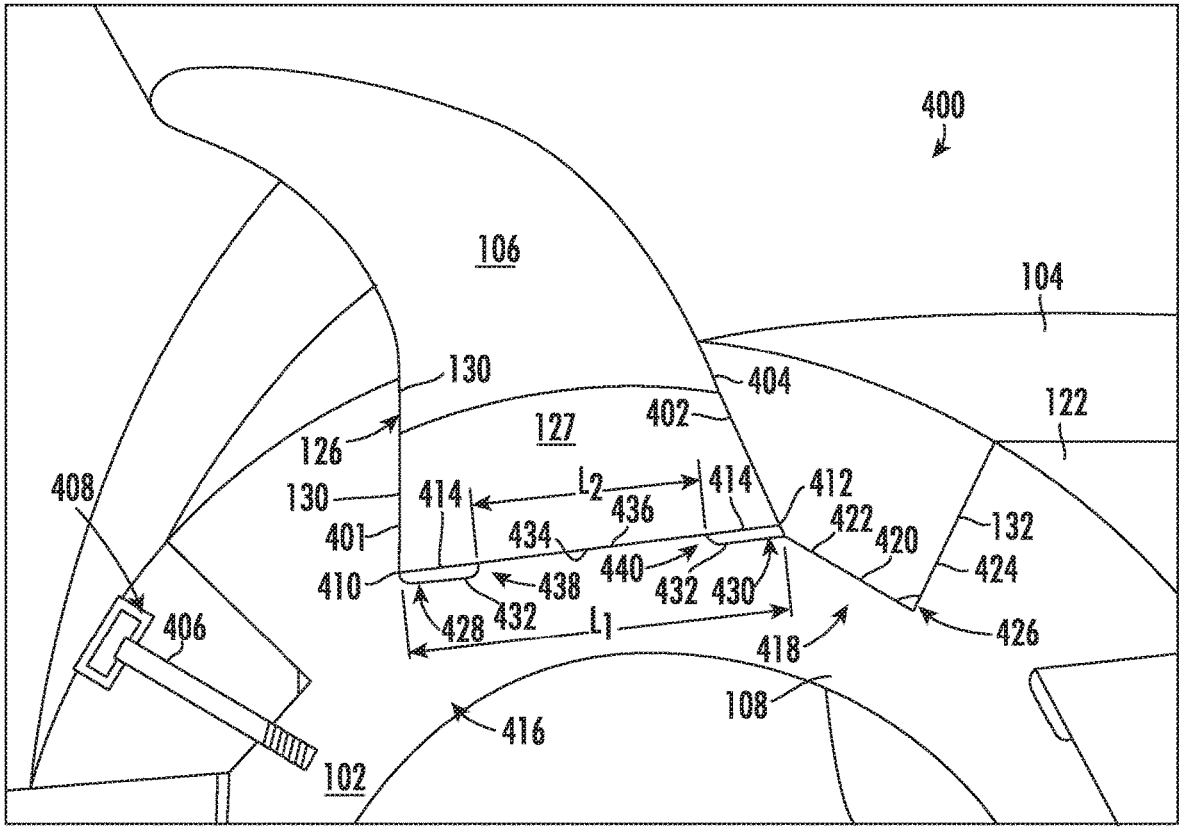
FIG. 4 is a perspective axial view, looking forward of a circumferential segment of the marine propeller assembly shown in FIG. 1.

FIG. 4 is an axial view, looking forward of a circumferential segment 400 of marine propeller assembly 100 (shown in FIG. 1). In the example embodiment, dovetail 127 is retained in dovetail groove 126 by undercut sidewall 130 engaging a complementary first dovetail sidewall 401 and by a first wedge sidewall 402 engaging a complementary second dovetail sidewall 404. Wedge 104 is retained in dovetail groove 126 by one or more fasteners, such as, but not limited to, one or more threaded fasteners 406, for example, one or more bolts. In the example embodiment, a head 408 of fastener 406 is countersunk into a radially outer surface of wedge 104.

In the exemplary implementation, dovetail 127 also includes a first circumferential end 410, an opposing second circumferential end 412, and a radially inner surface 414 extending therebetween for a first length L1. Furthermore, groove 126 of hub 102 includes a dovetail receiving portion 416 and an adjacent wedge receiving portion 418. Dovetail receiving portion 416 is configured to receive a corresponding dovetail 127 of blades 106 and wedge receiving portion 418 is configured to receive a corresponding wedge 104. More specifically, hub 102 includes a plurality of circumferentially-spaced dovetail receiving portions 416 that are alternatingly circumferentially-spaced with the plurality of wedge receiving portions 418.

In the exemplary embodiment, each dovetail 127 includes a first edge 411 at the intersection of sidewall 201 and inner surface 414 at first circumferential end 410. Furthermore, each dovetail 127 includes a second edge 413 at the intersection of sidewall 404 and inner surface 414 at second circumferential end 412. Edges 411 and 413 extend the full axial length of dovetail 127 and include a relief cut to facilitate relieving stresses concentrated at the intersection of sidewalls 401 and 404 and inner surface 414. In the exemplary embodiment, edges 411 and 413 are chamfered along their length. In another embodiment, edges 411 and 413 are rounded. Generally, edges 411 and 413 are modified in any manner that reduces stress as described herein and that facilitates operation of blades 106.

As shown in FIG. 4, each wedge 104 includes a radially inner wedge surface 420 that mates with a surface 422 of wedge receiving portion 418 and also includes a second wedge sidewall 424 that mates with second hub sidewall 132 to hold wedge 104 in place. Each wedge 104 also includes a relief cut 426 at the intersection of surface 420 and sidewall 424 such that a gap is formed between a portion of wedge 104 and hub 102. As described herein, relief cut 426 facilitates relieving stresses concentrated at the intersection of surface 420 and sidewall 424.

In the exemplary embodiment, radially inner surface 414 of dovetail 127 is spaced away from dovetail receiving portion 416 of groove 126 such that a gap 428 is formed therebetween. More specifically, a first gap 428 is formed at first circumferential end 410 of dovetail 127 between radially inner surface 414 and dovetail receiving portion 416. Similarly, a second gap 430 is formed at second circumferential end 412 of dovetail 127 between radially inner surface 414 and dovetail receiving portion 416. Gaps 428 and 430 extend circumferentially toward each other from respective circumferential ends 410 and 412 and extend axially from hub forward face 108 to hub aft face 110.

More specifically, dovetail receiving portion 416 includes a radially inner surface 432 that at least partially forms gaps 428 and 430. In the exemplary embodiment, dovetail receiving portion 416 also includes a platform 434 extending radially outward from radially inner surface 432. Platform 434 includes a dovetail receiving surface 436 that couples to dovetail inner surface 414 such that gaps 428 and 430 are defined between dovetail inner surface 414 and radially inner surface 432. Platform 434 includes a first circumferential end 438 and an opposing second circumferential end 440 that define a platform length L2 therebetween that is shorter than the length L1 of dovetail inner surface 414. In the exemplary embodiment, first gap 428 is positioned adjacent first circumferential end 438 and second gap 430 is positioned adjacent second circumferential end 440. More specifically, platform 434 extends perpendicularly from surface 432 and is substantially centered along dovetail inner surface 414 such that gaps 428 and 430 are substantially similar in circumferential length and radial depth. Alternatively, gaps 428 and 430 include different circumferential lengths and/or radial depths. First gap 428 is defined by dovetail inner surface 414, receiving portion inner surface 432, and platform first end 438. Second gap 430 is defined at least in part by wedge 104 and, more specifically, by platform second end 440, dovetail inner surface 414, receiving portion inner surface 432, and first wedge sidewall 402. In such a configuration, platform 434 is defined by forming grooves in surface 436 to form surface 432, which defines gaps 428 and 430 when dovetail 127 is coupled within slot 126.

In operation, blades 106 are preloaded into hub 102 to create a direct load path from the blade/media interface to hub 102 to a drive shaft (not shown in FIG. 4). When blades 106 are preloaded into hub 102, high stress concentrations can occur at the outer edges of dovetail 127 proximate the intersection of dovetail radially inner surface 414 with dovetail sidewalls 401 and 404, respectively. Formation of gaps 428 and 420 facilitate relieving these stresses. Gaps 428 and 430 vary in size and depth depending on the total size of blade 106 and the associated load.

Figure 5:
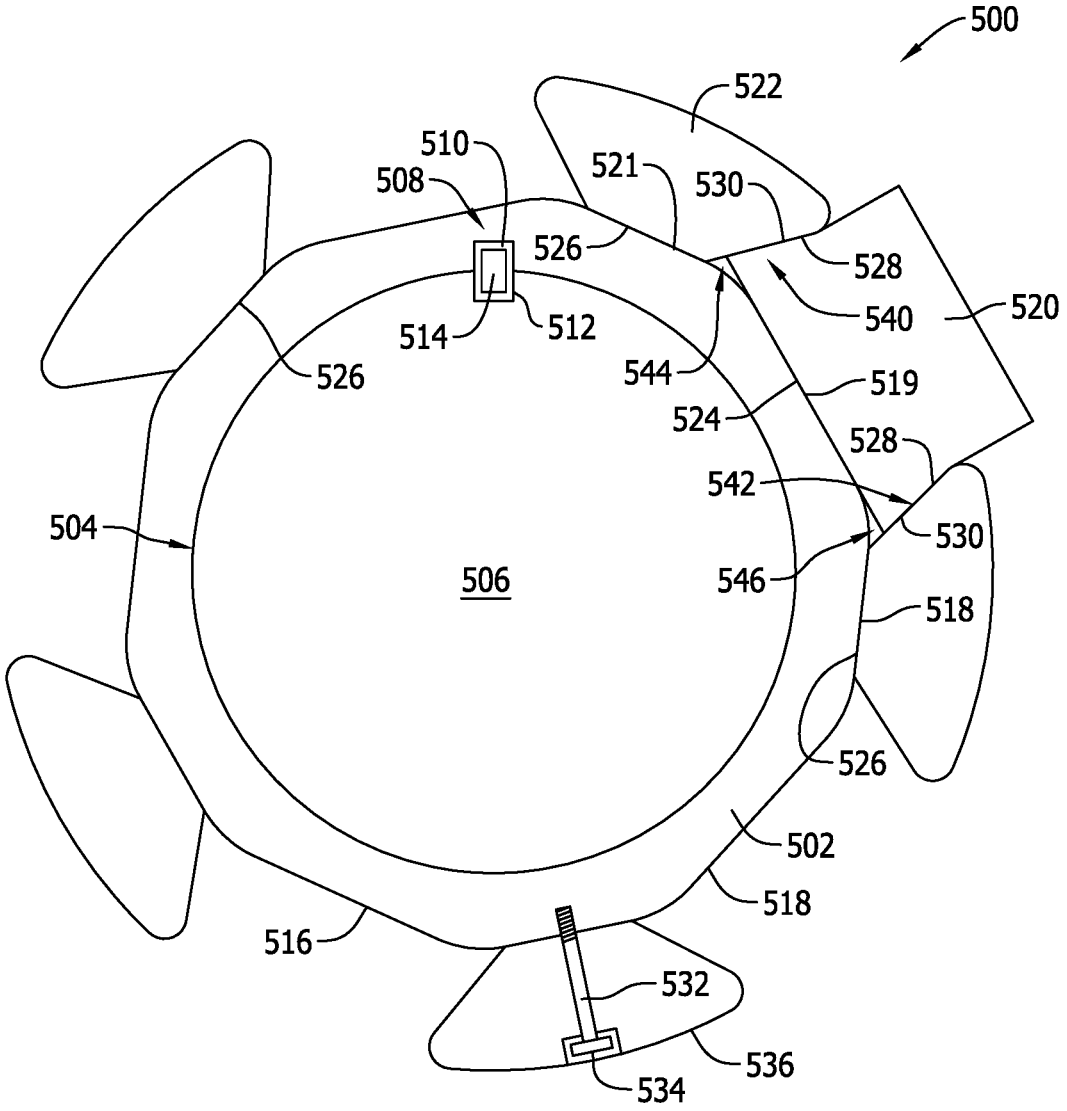
FIG. 5 is an axial view of another embodiment of a marine propeller assembly.

FIG. 5 is an axial view of another embodiment of a marine propeller assembly 500. In the example embodiment, a hub 502 includes a central bore 504 configured to receive a propulsion shaft 506 therethrough. In some embodiments, hub 502 is keyed onto propulsion shaft 506 using, for example, but not limited to, a keyed joint 508 including a keyway 510, a keyseat 512, and a key 514. Keyed joint 508 is used to connect hub 502 to propulsion shaft 506. Keyed joint 508 prevents relative rotation between connect hub 502 to propulsion shaft 506 and facilitates torque transmission between hub 502 and propulsion shaft 506. In one embodiment, an outer radial surface 516 of hub 502 includes a plurality of circumferentially-spaced flats 518. Each flat is configured to receive a blade dovetail 520 or a wedge 522. Specifically, flats 518 include a dovetail receiving portion 519 configured to mate with dovetail 520 and a wedge receiving portion 521 configured to receive wedge 522. Portions 519 and 521 are generally planar surfaces that are complementary to a planar radially inner surface 524 of dovetail 520 and a radially inner surface 526 of wedge 522. In various embodiments, flats 518 and surfaces 524 and 526 have contoured surfaces that are complementary with respect to each other. For example, flats may include a generally concave contour while surfaces 524 and 526 include a generally convex contour and vice versa. Other contours may be used and each contour may be a simple contour or may be a complex contour. Blade dovetail 520 is retained against hub by wedges 522 positioned on either circumferential side of blade dovetail 520. Sidewall 528 of wedges 522 are undercut to provide an interference fit with complementary sidewalls 530 of blade dovetail 520. Wedges 522 are retained against hub 502 using for example, fasteners 532, such as, but not limited to threaded fasteners, for example, bolts. In one embodiment, a head 534 of fastener 532 is countersunk into a radially outer surface 536 of wedge 522.

Dovetail 520 also includes a first circumferential end 540, an opposing second circumferential end 542. Similar to marine propeller assembly 400 (shown in FIG. 4), radially inner surface 524 of dovetail 520 is spaced away from dovetail receiving portion 519 such that a gap 544 is formed therebetween. More specifically, a first gap 544 is formed at first circumferential end 540 of dovetail 520 between radially inner surface 524 and dovetail receiving portion 519. Similarly, a second gap 546 is formed at second circumferential end 542 of dovetail 520 between radially inner surface 524 and dovetail receiving portion 519. Gaps 544 and 546 extend circumferentially toward each other from respective circumferential ends 540 and 542.

An exemplary technical effect of the methods, systems, and apparatus described herein includes at least one of: (a) creation of a direct load path through the propeller blades, the hub, and the drive shaft; (b) reduction of stress concentrations where the blades couple to the hub; and (c) reduction in cost of parts and labor due to an extended operational service time of the blades.

The above-described embodiments of an apparatus and system of retaining a separable composite marine propeller assembly on a propulsive shaft of a watercraft provides a cost-effective and reliable means for operating and maintaining the marine propeller assembly. More specifically, the apparatus and system described herein facilitate forming gaps between a portion of the blade dovetails and the hub to reduce the level of stress concentrations that may occur at the intersection thereof. As a result, the apparatus and system described herein facilitate operating a large commercial water craft in a cost-effective and reliable manner.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A propeller assembly comprising:

a plurality of circumferentially-spaced blades, each blade comprising a dovetail comprising a first circumferential end, a second circumferential end, and a radial inner surface defining a plane extending between the first circumferential end and the second circumferential end, the radial inner surface extending completely between the first circumferential end and the second circumferential end along the plane;

a plurality of circumferentially-spaced wedges, each wedge including a first wedge sidewall, a second wedge sidewall circumferentially spaced opposite the first wedge sidewall, and a radial inner wedge surface extending between the first wedge sidewall and the second wedge sidewall; and a hub defining a plurality of dovetail grooves, each dovetail groove comprising a circumferentially-spaced dovetail receiving portion, each dovetail receiving portion configured to receive a corresponding dovetail of said plurality of blades, wherein at least one gap is formed between said radial inner surface and at least a portion of said dovetail receiving portion, each dovetail groove further comprising a circumferentially-spaced wedge receiving portion, each wedge receiving portion configured to receive a corresponding wedge of said plurality of wedges such that the first wedge sidewall is positioned adjacent to the second circumferential end of a blade of the plurality of blades, wherein each wedge includes a relief cut at an intersection of the radial inner wedge surface and the second wedge sidewall such that a relief gap is formed between said radial inner wedge surface and at least a portion of said wedge receiving portion.

2. The propeller assembly of claim 1, wherein said at least one gap comprises a plurality of gaps.

3. The propeller assembly of claim 1, wherein said at least one gap is formed proximate at least one of said first and said second circumferential ends.

4. The propeller assembly of claim 3, wherein said at least one gap comprises a first gap positioned at said first circumferential end and a second gap positioned at said second circumferential end.

5. The propeller assembly of claim 3, wherein said at least one gap extends circumferentially from at least one of said first circumferential end and said second circumferential end.

6. The propeller assembly of claim 1, wherein said hub comprises a forward face and an aft face, wherein said at least one gap extends between said forward face and said aft face.

7. The propeller assembly of claim 1, wherein said dovetail receiving portion comprises a receiving radial inner surface and a platform extending radially outward from said receiving radial inner surface, wherein said platform comprises a dovetail receiving surface configured to couple to said radial inner surface of said dovetail, wherein said at least one gap is defined between said radial inner surface of said dovetail and receiving radial inner surface of said dovetail receiving portion.

8. The propeller assembly of claim 7, wherein said platform comprises a first circumferential length and said dovetail comprises a second circumferential length longer than the first circumferential length.

9. The propeller assembly of claim 7, wherein said at least one gap comprises a first gap positioned at a first circumferential end of said platform and a second gap positioned at a second circumferential end of said platform.

10. The propeller assembly of claim 1, wherein each wedge of the plurality of wedges is coupled to a corresponding wedge receiving portion.

11. The propeller assembly of claim 10, wherein said wedge receiving portions are alternatingly circumferentially-spaced with said dovetail receiving portions, and wherein said plurality of wedges at least partially define said at least one gap.

12. A hub for use with a marine propeller assembly, said hub comprising:

a plurality of circumferentially-spaced wedge receiving portions, each wedge receiving portion configured to receive a corresponding wedge of a plurality of wedges, wherein each wedge comprises a first wedge sidewall, a second wedge sidewall circumferentially spaced opposite the first wedge sidewall, and a radial inner wedge surface extending between the first wedge sidewall and the second wedge sidewall;

a plurality of circumferentially-spaced dovetail receiving portions, each dovetail receiving portion configured to receive a corresponding blade of a plurality of blades, wherein each blade comprises a dovetail having a first circumferential end, a second circumferential end, and a radial inner surface defining a plane extending between the first circumferential end and the second circumferential end, the radial inner surface extending completely between the first circumferential end and the second circumferential end along the plane, wherein each wedge includes a relief cut at an intersection of the radial inner wedge surface and the second wedge sidewall such that a relief gap is formed between said radial inner wedge surface and at least a portion of said wedge receiving portion, wherein said wedge receiving portions are alternatingly circumferentially-spaced with said dovetail receiving portions such that the first wedge sidewall is configured to be positioned adjacent to the second circumferential end of a blade of the plurality of blades, and wherein at least one gap is formed between said radial inner surface and at least a portion of said dovetail receiving portion.

13. The hub of claim 12, wherein said at least one gap comprises a first gap positioned at said first circumferential end and a second gap positioned at said second circumferential end.

14. The hub of claim 12, wherein said dovetail receiving portion comprises a receiving radial inner surface and a platform extending radially outward from said receiving radial inner surface, wherein said platform comprises a dovetail receiving surface configured to couple to said radial inner surface of said dovetail, wherein said at least one gap is defined between said radial inner surface of said dovetail and said receiving radial inner surface of said receiving portion.

15. The hub of claim 14, wherein said at least one gap comprises a first gap positioned at a first circumferential end of said platform and a second gap positioned at a second circumferential end of said platform.

16. The hub of claim 14, wherein said platform comprises a first circumferential length and said dovetail comprises a second circumferential length longer than the first circumferential length.

17. A marine propeller system comprising:

a rotatable propulsive shaft extending away from a hull of a water craft;

a plurality of circumferentially-spaced blades, each blade comprising a dovetail comprising a first circumferential end, a second circumferential end, and a radial inner surface defining a plane extending between the first circumferential end and the second circumferential end, the radial inner surface extending completely between the first circumferential end and the second circumferential end along the plane;

a plurality of circumferentially-spaced wedges, each wedge including a first wedge sidewall, a second wedge sidewall circumferentially spaced opposite the first wedge sidewall, and a radial inner wedge surface extending between the first wedge sidewall and the second wedge sidewall; and a hub defining a plurality of dovetail grooves, each dovetail groove comprising a circumferentially-spaced dovetail receiving portion, each dovetail receiving portion configured to receive a corresponding dovetail of said plurality of blades, wherein at least one gap is formed between said radial inner surface and at least a portion of said dovetail receiving portion, each dovetail groove further comprising a circumferentially-spaced wedge receiving portion, each wedge receiving portion configured to receive a corresponding wedge of said plurality of wedges such that the first wedge sidewall is positioned adjacent to the second circumferential end of a blade of the plurality of blades, wherein each wedge includes a relief cut at the intersection of the radial inner wedge surface and the second wedge sidewall such that a relief gap is formed between said radial inner wedge surface and at least a portion of said wedge receiving portion.

18. The marine propeller system of claim 17, wherein said at least one gap comprises a first gap positioned at said first circumferential end and a second gap positioned at said second circumferential end.

19. The marine propeller system of claim 17, wherein said dovetail receiving portion comprises a receiving radial inner surface and a platform extending radially outward from said receiving radial inner surface, wherein said platform comprises a dovetail receiving surface configured to couple to said radial inner surface of said dovetail, wherein said at least one gap is defined between said radial inner surface of said dovetail and said receiving radial inner surface of said dovetail receiving portion.

20. The marine propulsion system of claim 19, wherein said platform comprises a first circumferential length and said dovetail comprises a second circumferential length longer than the first circumferential length.

* * * * *